United States Patent [19]

Müller et al.

[11] Patent Number: 4,583,988

[45] Date of Patent: Apr. 22, 1986

[54] PROCESS FOR DYEING MODIFIED POLYESTER FIBER TEXTILE MATERIAL IN ABSENCE OF CARRIER WITH WATER-INSOLUBLE REACTIVE DISPERSE DYES

[75] Inventors: Siegfried Müller, Kelkheim; Hans-Peter Maier, Sulzbach, both of Fed. Rep. of Germany

[73] Assignee: Hoechst Akteingesellschaft, Fed. Rep. of Germany

[21] Appl. No.: 550,743

[22] Filed: Nov. 10, 1983

[51] Int. Cl.[4] ..... D06P 1/38; D06P 3/54; D06P 5/02

[52] U.S. Cl. ..... 8/543; 8/532; 8/533; 8/549; 8/922

[58] Field of Search ..... 8/539, 543, 693, 694, 8/549

[56] References Cited

U.S. PATENT DOCUMENTS

| | | | |
|---|---|---|---|
| 3,052,653 | 9/1962 | Iannicelli | 8/539 |
| 3,386,990 | 6/1968 | Dale et al. | 8/543 |
| 3,458,537 | 7/1969 | Johnson | 8/694 |
| 3,764,264 | 10/1973 | Bowers et al. | 8/179 |
| 3,864,315 | 2/1975 | Ohno et al. | 8/539 |
| 3,954,396 | 5/1976 | Ribka et al. | 8/693 |
| 4,014,647 | 3/1977 | Neeff | 8/694 |
| 4,049,633 | 9/1977 | Penton | 8/539 |
| 4,056,356 | 11/1977 | Gilkey et al. | 8/539 |
| 4,076,783 | 2/1978 | Yasuda et al. | 8/539 |
| 4,097,229 | 6/1978 | Koller et al. | 8/543 |
| 4,115,056 | 9/1978 | Koller et al. | 8/543 |

FOREIGN PATENT DOCUMENTS

| | | |
|---|---|---|
| 2362683 | 6/1975 | Fed. Rep. of Germany . |
| 896041 | 5/1962 | United Kingdom . |

*Primary Examiner*—A. Lionel Clingman

*Attorney, Agent, or Firm*—Connolly and Hutz

[57] ABSTRACT

Poor wet fastness properties and unsatisfactory fastness to thermofixing of dyeings on carrierfree-dyeing PES fibers with conventional disperse dyestuffs preclude the deployment of textile material of this type in the industrial wear and contract business, such as for utilitarian textiles, sportswear or the like. The reduced boil-wash stability of such disperse dyestuffs on the modified fibers can lead to washing problems because of the risk of bleeding.

Using disperse dyestuffs which contain highly polarized groupings in the molecule for dyeing carrierfree-dyeing PES fibers by the exhaust method, by the padding technique or by the padding/wind-up technique considerably improves the dyeing results in respect of the fastness properties sought and hence opens up further areas of use for said types of fiber.

18 Claims, No Drawings

PROCESS FOR DYEING MODIFIED POLYESTER FIBER TEXTILE MATERIAL IN ABSENCE OF CARRIER WITH WATER-INSOLUBLE REACTIVE DISPERSE DYES

The present invention relates to a process for the carrier-free dyeing, with water-insoluble disperse dyestuffs, of fiber material which consists of or contains polyesters modified by cocondensing bifunctional ester-forming monomeric compound chain members which loosen up the normal rigidity of the uniform polymeric fiber structure.

A dyeing method for the abovementioned types of polyester (PES) fibers using the exhaust technique has in fact already been extensively described in the journals chemiefasern/textil-industrie 27/79 (1977), pages 336–339 and 452–454 and MELLIAND TEXTILBERICHTE 62 (1981), pages 795–800, where the goods are dyed from an aqueous medium with commercially available disperse dyestuffs in finely divided form. Even though the existence of such PES fibers, which, by virtue of a special modification to the basic fiber constituents, can be dyed without the application of carriers at as low a temperature as the boiling temperature, makes it possible under these conditions to obtain, within the scope of this known discontinuous working method, higher color yields with the customary type of disperse dyestuff than on unmodified polyester fibers at 130° C., which, in addition to dispensing with the use of carrier entirely, allows the amount of dyestuff to be cut back, and even though the dyeing time in exhaust dyeing can be shortened by a maximum amount of 30%, compared with the dyeing of the "normal"-dyeing PES fiber type, there are—as the reference cited also mentions—nevertheless considerable disadvantages associated with the choice of dyestuff made there, namely, above all, in that on such modified polyester fibers conventional disperse dyestuffs always produce dyeings of only very limited fastness properties. More particularly, it is criticized that, among the wet fastness properties, the stability to boil-washing is worse than that of the standard polyethylene terephthalate fiber.

Similar reservations have also been voiced in respect of the dyeing results when commercially available disperse dyestuffs are used for the one-bath dyeing of modified polyester (PES) fiber types in a mixture with wool using the Thermosol wet development technique as described in German Pat. No. 2,658,062 or using the pad/wind-up or pad/hot-batch technique as described in German Pat. No. 2,658,061, although even the mere presence of such PES fibers as a component of a blend produces as part of the known continuous method for dyeing these fiber blends marked advantages over the "normal"-dyeing, unmodified polyester fibers in terms of a reduction of the fixing temperature and fixing time for the customary type of disperse dyestuff without having to use at the same time dyestuff carriers or solvents suitable for such a purpose and even the action of saturated steam is sufficient for thermofixing, and it is the same fact which similarly makes it possible in the known discontinuous methods for dyeing these fiber blends to dye conventional disperse dyestuffs in a batching process at temperatures of 100° C. or moderately above and without using at the same time dyestuff carriers or solvents suitable for such a purpose.

Further, dyeings with known disperse dyestuffs on carrier-free-dyeing polyester fibers are not only insufficiently stable to boil-washing but also have a reduced wash fastness in the 60° C. wash. However, any type of commerical workwear and utilitarian textiles must be able to withstand washing at the boil. Because of the limits which have been found for the wet fastness properties of dyeings on modified polyester fibers, these types of fiber are not suitable for the manufacture of such articles. Even the sublimation fastness of dyeings on said PES modification textile material is reduced for deep shades if conventional disperse dyestuffs are used on unblended fiber material and is therefore unsatisfactory.

It is then the purpose of the present invention to remedy the abovementioned deficiencies which arise in the dyeing of modified polyester fibers and to obtain satisfactory fast dyeings on textile material exclusively made of such fibers or on the corresponding component of fiber blends using commercially customary dyeing processes. This should considerably broaden the application sector for these types of fiber.

This object is achieved according to the invention by using, as colorants, disperse dyestuffs which contain in the molecule at least one highly polarized grouping bonded to an aromatic nucleus of the chromophore and fixing these dyestuffs on the fiber from an aqueous dispersion at pH 5–10 by means of heat or by allowing the dyeings to stand.

The advantages which are realized as a result of these measures are good boil-wash and sublimation fastness properties of these dyeings, even in deep shades. The wash fastness properties in the 60° C. wash, which were formerly inadequate, can now be called very good. The fiber material can from now on be used in the industrial wear and contract business, i.e. for any type of utilitarian textiles. Nor is it any longer out of the question to use it for sportswear or as linen (for example linen for infirmaries and nursing homes). These fibers, blended with cellulose fibers, can now even be used for trimmings, which was not possible before since cellulose fibers by themselves are not admissible for trimmings.

This result was surprising insofar as the use of disperse dyestuffs having highly polarized groupings in dyeings on normal PES fibers yields no benefit whatsoever in terms of dyeing properties compared with those using conventional disperse dyestuffs. By contrast, the disperse dyestuffs containing highly polarized groupings have been found to be advantageous in the dyeing of modified fibers which, in certain regions of the structure, have loosened molecular segments.

Suitable dyestuffs for the dyeing process according to the invention are all water-insoluble disperse dyestuffs which, in a finely divided state, are otherwise also suitable for dyeing synthetic fiber material, provided they have in the present case a highly polarized grouping. Most of the representatives of this class of dyestuff are structurally azo, anthraquinone, nitro or quinophthalone compounds, are predominantly carboxyl- and/or sulfo-free and without exception carry in the molecule at least one highly polarized grouping bonded to an aromatic nucleus of the chromophore. Said highly polarized grouping in the disperse dyestuffs used is mainly a radical based on a side chain having an $—SO_2—$ or —CO— bridge member.This primarily means the vinyl sulfone radical. Satisfactory results are, furthermore, also obtained with disperse dyestuffs which are substituted by the acrylic acid radical or a dialkyl-($C_1$–$C_4$-)aminosulfone radical. The disperse dyestuffs which can be used according to the invention can contain several highly polarized groupings of said type, which may be of differing natures, on the same dyestuff molecule.

The dyestuffs, as is customary for disperse dyestuffs, are dispersed and are then added to the dyebath in the customary manner. The dyeing is generally carried out at pH 5–10. It is known from experience that the best color yields are obtained at pH 7–9.

The textile material dyed in the present dyeing process can, in principle, be made of any polyester fiber which can be dyed without carrier at the boil. Examples of suitable candidates are polyesters modified with aliphatic dicarboxylic acids, hydroxycarboxylic acids on long-chain diols, such as polyethylene terephthalate fibers modified with polyethylene oxide in the form of a block copolymer. Natural components of blends with said modified polyester fibers are in the main cellulose fibers or even wool fibers.

With this fiber material, it is of no importance how the dyeing operation is performed.

For example, if a discontinuous exhaust method is used it is immaterial whether the exhausting bath is at the boil (i.e. at temperatures between 95° and 100° C.), or under high-temperature (HT) conditions between 100° C. and 135° C. HT conditions may, in certain circumstances, even produce up to 20% deeper dyeings.

In the same way it is of no concern if a fully continuous sequence of dyeing measures is used whether the procedure is a pad/steam or pad/wet-steam process or a pad/thermosol process (dyestuff fixation by dry heat in the form of hot air or superheated steam, contact heat or IR radiation). There are no notably serious differences in color yield between these application methods. The only important point is that with continuous methods of this type a heat treatment takes place subsequent to the padding step, if appropriate after an intermediate drying of the goods.

Finally, it has been found that it does not matter in the course of using partially continuous working techniques whether the dyeing operation is performed using a pad/cold-batch, a pad/hot-batch or a pad/roll process. Supplied heat will in any case shorten the dyestuff fixation dwell time by an amount which depends on the level of the temperature. A brief heat treatment after a dwell at room temperature, either by means of dry heat or by means of steaming, will always deepen the shade on the goods.

The process according to the invention, using disperse dyestuffs which contain highly polarizing groupings, does of course preserve all those advances in dyeability and dyeing conditions with conventional disperse dyestuffs over the standard PES fiber types which are solely due from the start to the modification of the fiber material. Dispensing with the use of carriers in the case of carrierfree-dyeing polyester fibers results here again not only in a reduction of the dyeing costs and a simplification of the dyeing methods but also in further advantages, both for the exhaust process and, to a stronger degree, for continuous processes.

For example the tricot industry frequently does its dyeing on open reel becks. If standard, i.e. unmodified, polyester fibers are to be dyed, carrier substances have to be used in addition to the disperse dyestuffs. However, this requirement then in turn makes it more difficult to clean the waste water. For this reason the use of these substances is prohibited in some parts of West Germany. The invention thus not only widens the applicability of certain modified polyester fibers to include special areas of use, but the abovementioned novel dyeing process also makes a considerable contribution to the protection of the environment.

Compared with exhaust methods, padding methods, even if they are discontinuous dyeing processes, or pronounced batching processes, are time- and labor-saving dyeing methods. As a result of the fact that they use much less water in the liquor, the waste water pollution is generally not so high in a padding method than in an exhaust method. In addition, it is simpler and less expensive to remove the padding liquor, since there is much less of it, albeit more concentrated.

Beyond that, pad/wind-up methods have the further advantage that they do not make great demands on the available plant. This means that even relatively small factories where the yardage is relatively small can make use of this dyeing method. A factor which must not be left out of consideration is the enormous saving in energy which results from batching at room temperature. Padding followed by winding onto a batching roller and leaving for, for example, about 24 hours at room temperature produces sufficiently deep dyeings which have the abovementioned good fastness properties.

According to the invention, it is easily possible to shorten the dwell time. It can be reduced to a quarter of the original time if the dwell phase is followed by a short heat treatment. In this way remarkably level and very deep shades are obtained.

The following examples serve to illustrate the invention. The percentages given therein are by weight and are based in the case of the liquor pick-up data on the weight of the dry goods.

EXAMPLE 1

1 kg of a fabric which consists of carrier-free-dyeing polyethylene terephthalate fibers modified with polyethylene oxide in the form of a block copolymer is treated on a reel beck at the boil for 60 minutes and at a liquor ratio of 30:1 in an aqueous liquor which contains 1.5% of the disperse dyestuff of the formula

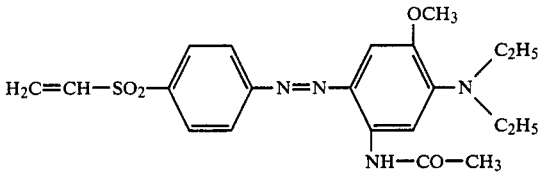

in the form of a fine dispersion and, per liter, 1 g of sodium 2,2′-dinaphthylmethane-6,6′-disulfonate as a dispersant and which has been brought to pH 7–8.

The fiber material treated in this way is then finished by a soap at the boil in an aqueous neutral bath. The above measures produce on the substrate a full and level red dyeing which has excellent boil-wash and thermofixing fastness properties.

The auxiliary used in the above exhaust process was only added as a precaution because of the relatively high dyestuff level and need not necessarily have been present in the dyebath.

EXAMPLE 2

800 g of yarn which consists of carrierfree-dyeing polyethylene terephthalate fibers modified with polyethylene oxide in the form of a block copolymer are cross-wound onto two packages which are treated in a sealed apparatus at the boil and a liquor ratio of 15:1 for 50 minutes with an aqueous liquor which, in addition to a dispersant of the same type as described in Example 1, also contains 2% of the disperse dyestuff of the formula

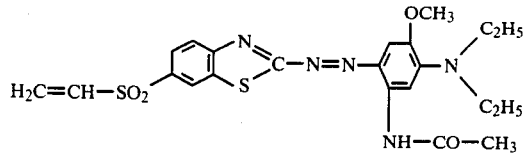

and has been adjusted to virtually neutral. The liquor flow rate through the packages in the course of the exhaustion taking place in the present case is 22 liters/-minute per kg of yarn, and the direction of liquor flow alternates between 4 minutes from out to in and 3 minutes from in to out.

The goods thus dyed are rinsed with water and are then soaped at the boil in a neutral aqueous bath. There are obtained on the yarn a very level deep blue dyeing having very good thermofixing fastness.

Equally good fasteners properties as in the above Example are obtained by performing the dyeing operation under identical conditions, but using the disperse dyestuff of the formula

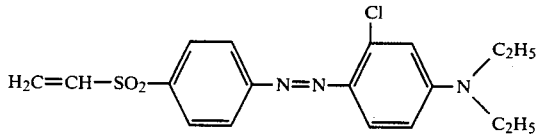

The resulting shade is in this case orange.

EXAMPLE 3

20 g of the disperse dyestuff of the formula

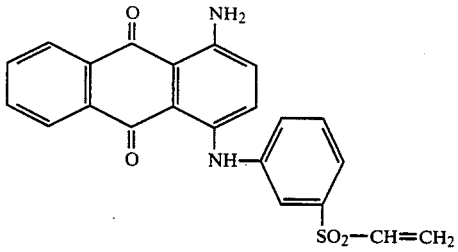

are finely dispersed in a customary manner in 1 liter of cold water which contains, as a dispersant, 1 g of sodium 2,2'-dinaphthylmethane-6,6'-disulfonate, and the dispersion is brought to virtually neutral.

Slubbing of carrierfree-dyeing polyethylene terephthalate fibers modified with polyethylene oxide in the form of a black copolymer is then padded with this liquor at room temperature on a pad-mangle and is squeezed to a liquor pick-up of about 80%. To fix the dyestuff on it, the slubbing thus impregnated, without intermediate drying, is then continuously passed for 5 minutes at a temperature of 105° C. through a steamer.

The level and full blue dyeing which results on the textile material thus treated is rinsed in water and is then soaped at the boil in a neutral aqueous bath. It then has excellent wet fastness properties and a very good sublimation fastness.

EXAMPLE 4

A sample of velvet from carrierfree-dyeing polyethylene terephthalate fibers modified with polyethylene oxide in the form of a block copolymer is impregnated at room temperature with an aqueous liquor which contains per liter 30 g of the disperse dyestuff of the formula

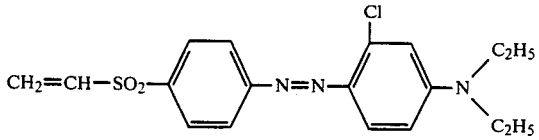

(in the form of a finely divided dispersion), 1 g of a reaction product of 1 mole of isotridecyl alcohol with 8 moles of ethylene oxide, and 1 g of sodium oleylmethyltaurine and has been brought to about pH 8. After the squeeze the liquor pick-up is about 120%. The dyestuff is then fixed on the modified PES fiber by taking the material as it is, without intermediate drying, and steaming it for 12 minutes with saturated steam at 120° C.

In this way the sample of velvet is dyed an orange shade having good wash and rubbing fastness properties.

The combination of auxiliaries in the above dyeing was only used to retain the character of the textile material in full.

EXAMPLE 5

A fabric which consists of carrierfree-dyeing polyethylene terephthalate fibers modified with polyethylene oxide in the form of a block copolymer is padded at room temperature with an aqueous liquor which contains per liter 20 g of the disperse dyestuffs of the formula

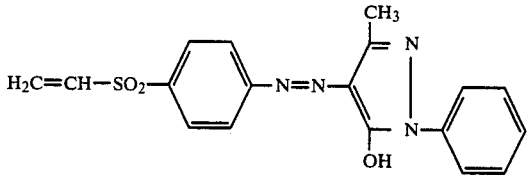

in a finely divided form and has been brought to pH 7–8. The dip on the pad-mangle is performed twice in order to ensure that the material being dyed is completely wetted out. The liquor pick-up in the course of these application measures is about 50%. The material thus treated is then dried at about 120° C. and, to fix the dyestuff, is then exposed to dry heat at 190° C. for 40 seconds.

The dyeing is finished by soaping off at the boil in a neutral aqueous bath to produce on the material a level full yellow shade which is distinquished by very good light, thermofixing and wash fastness properties.

Similar results as in the above Example are obtained by dyeing under the same conditions, but replacing the dyestuff used there by identical amounts of the disperse dyestuff of the formula

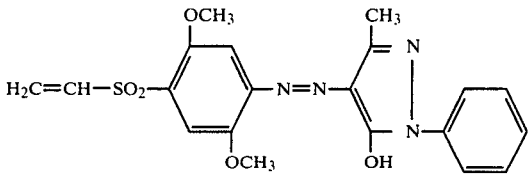

The dyeing then produces on the textile material a brilliant clear golden yellow which has excellent light fastness.

EXAMPLE 6

A fabric which consists of carrierfree-dyeing polyethylene terephthalate fibers modified with polyethylene oxide in the form of a block copolymer is padded at room temperature on a pad-mangle to a pick-up of about 60% of an aqueous liquor which contains per liter 20 g of the disperse dyestuff of the formula

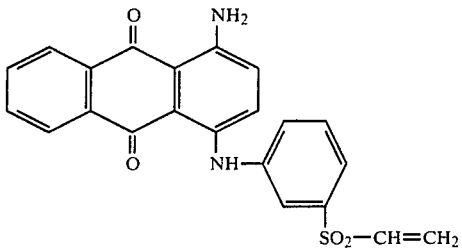

in finely divided form and has been brought to pH 7–8, is then wound onto a batching roller in the moist state and is left to dwell under the same temperature conditions to fix the dyestuff on the fiber material. In order to prevent the fabric thus treated from drying out in the course of the dwell and also to exclude any other influences, the batching roller is sealed airtight by wrapping in plastic sheeting.

After a dwell time of 24 hours the dyed fabric is successively rinsed with water, washed in warm water at 70° C. and soaped off at the boil for 5 minutes. The result on the substrate is a level blue dyeing having very good wet and thermofixing properties.

EXAMPLE 7

A fabric padded as in Example 6 and left to dwell for 12 hours is subjected in the course of the unwinding from the batching roller to a hot air treatment at 160° C. for 60 seconds and is then finished in the same way as described there by soaping at the boil. The result on the textile web then is a level, slightly deeper blue dyeing than that obtained according to the instructions in Example 6.

The same dyeing results are obtained by subjecting the cold-batched material not to dry heat but to a steaming at 105° C. for 2 minutes.

EXAMPLE 8

A fabric which consists of carrierfree-dyeing polyethylene terephthalate fibers modified with polyethylene oxide in the form of a block copolymer is padded at room temperature on a pad-mangle to a pick-up of about 55% of an aqueous liquor which contains per liter 30 g of the disperse dyestuff of the formula

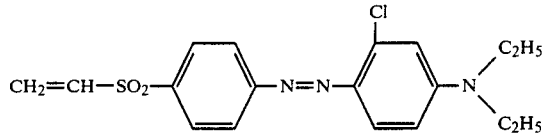

in a conventionally finely divided state and has been brought to about pH 8, and is wound onto a batching roller. The batching roller is then sealed airtight as described in Example 6 and the wound textile material is left to rotate slowly at room temperature in order to fix the dyestuff.

Immediately after the 24-hour treatment under room temperature conditions the fiber material thus dyed is finished in the customary manner by rinsing with water, washing in warm water at about 70° C. and then soaping at the boil for 5 minutes. In this way an orange dyeing having good wash and rubbing fastness properties is obtained on the fabric.

If the nature of the textile material makes it necessary, a wetting agent and, if appropriate, a dispersant may be added to the padding liquor without adverse effect.

We claim:

1. In a process for the carrier-free dyeing, with water-insoluble disperse dyestuffs, of fiber material containing a polyethylene terephthalate which has been modified by co-condensing with an hydroxycarboxylic acid, an aliphatic dicarboxylic acid or a polyethylene oxide in the form of a block copolymer, the improvement which comprises:

using, as a colorant, at least one disperse dyestuff which is free of COOH or $SO_3H$ groups or both and which contains in the dyestuff molecule one or a plurality of groupings exhibiting polar character, each said polar grouping being a vinyl sulfone, dialkylaminosulfone, or acrylic acid radical bonded to an aromatic nucleus of the chromphore; in the case of a plurality of said polar groupings, said polar groupings being the same or different; and fixing the dyestuff on the fiber from an aqueous dispersion at a pH of 5–10 by means of heat or by allowing the dyeings to stand.

2. The process as claimed in claim 1, wherein several said polar groupings are present on the same molecule in the disperse dyestuff.

3. The process as claimed in claim 1, wherein the dyeing is performed at pH 7–9.

4. The process as claimed in claim 1, wherein the dyeing, including the fixing of the dyestuff under heat, is performed using the exhaust method.

5. The process as claimed in claim 4, wherein the dyeing is performed at the boil between 95° and 100° C.

6. The process as claimed in claim 4, wherein the dyeing is performed under high-temperature (HT) conditions between 100° and 135° C.

7. The process as claimed in claim 1, wherein the dyeing, including the fixing of the dyestuff under heat, is performed using a continuous method utilizing the padding technique.

8. The process as claimed in claim 7, wherein the dyeing is performed using a pad-steam process or a pad/wet-steam process.

9. The process as claimed in claim 7, wherein the dyeing is performed using a pad-thermosol process.

10. The process as claimed in claim 1, wherein the dyeing, including the fixing of the dyestuff by leaving the dyed material to dwell, is performed using a semi-continuous method utilizing the pad/wind-up technique.

11. The process as claimed in claim 10, wherein the dyeing is performed using a pad/hot-batch process.

12. The process as claimed in claim 10, wherein the dyeing is performed using a pad/cold-batch process.

13. The process as claimed in claim 10, wherein the dyeing is performed using a pad roll process.

14. The process as claimed in claim 12, wherein after the dwell time to fix the dyestuff at room temperature has expired the fiber material is briefly heat-treated, either by means of dry heat or by steaming.

15. The process as claimed in claim 1, wherein the carrierfree-dyeing polyester fiber is a polyethylene terephthalate fiber modified with hydroxycarboxylic acids.

16. The process as claimed in claim 1, wherein the carrierfree-dyeing polyester fiber is a polyethylene terephthalate fiber modified with aliphatic dicarboxylic acids.

17. The process as claimed in claim 1, wherein the carrierfree-dyeing polyester fiber is a polyethylene terephthalate fiber modified with polyethylene oxide in the form of a block copolymer.

18. A process for the carrier-free dyeing, with water-insoluble disperse dyestuffs, of fiber material, said process comprising:

coloring with a said disperse dyestuff, fiber material containing polyethylene terephthalate modified by condensing with an hydroxycarboxylic acid, an aliphatic dicarboxylic acid or a polyethylene oxide in the form of a block copolymer; said disperse dyestuff containing in the dyestuff molecule a chromophore having an aromatic nucleus and at least one vinyl sulfone, dialkylaminosulfone, or acrylic acid radical, or a combination of said radicals, bonded to a said aromatic nucleus; and fixing said disperse dyestuff on said fiber material from an aqueous dispersion at pH 5–10 by means of heat or by allowing the dyeing to stand.

* * * * *